US010570647B2

(12) United States Patent
Kindstrand et al.

(10) Patent No.: US 10,570,647 B2
(45) Date of Patent: Feb. 25, 2020

(54) HOOP LOCK WITH DUAL LOCKING

(71) Applicant: Schlage Lock Company LLC, Indianapolis, IN (US)

(72) Inventors: Daniel Hugh Kindstrand, Pembroke, MA (US); Manjunatha Ramakrishna, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 201 days.

(21) Appl. No.: 14/738,019

(22) Filed: Jun. 12, 2015

(65) Prior Publication Data

US 2015/0361692 A1 Dec. 17, 2015

Related U.S. Application Data

(60) Provisional application No. 62/011,470, filed on Jun. 12, 2014.

(51) Int. Cl.
*E05B 67/22* (2006.01)
*E05B 67/06* (2006.01)

(52) U.S. Cl.
CPC ..... *E05B 67/063* (2013.01); *E05B 67/06* (2013.01); *E05B 67/22* (2013.01); *Y10T 70/491* (2015.04)

(58) Field of Classification Search
CPC .... E05B 67/063; E05B 67/066; E05B 17/002; E05B 67/00; E05B 67/003; E05B 67/06; E05B 67/22; E05B 67/24; E05B 67/26; Y10T 70/491; A61B 6/14
USPC ..... 70/DIG. 3, 38 A, 39, 53, 233
See application file for complete search history.

(56) References Cited

U.S. PATENT DOCUMENTS 348,521 A * 8/1886 Hillebrand ..... E05B 67/063 70/39
1,420,578 A * 6/1922 Reichstein ..... E05B 37/025 70/26
1,580,574 A * 4/1926 Segal ..... E05B 67/24 70/367
2,433,114 A * 12/1947 Gray ..... E05B 67/24 70/367
3,349,584 A * 10/1967 Russell ..... E05B 37/0034 70/21

(Continued)

FOREIGN PATENT DOCUMENTS

CN 102140867 A 8/2011
CN 103867038 A 6/2014

(Continued)

OTHER PUBLICATIONS

International Search Report; International Searching Authority; International PCT Application No. PCT/US2015/035575; dated Nov. 4, 2015; 4 pages.

(Continued)

*Primary Examiner* — Peter M. Cuomo
*Assistant Examiner* — Morgan J McClure
(74) *Attorney, Agent, or Firm* — Taft Stettinius & Hollister LLP

(57) ABSTRACT

A hoop lock including a shackle, a crossbar, and a locking assembly operable to secure the shackle to the crossbar. The shackle may include a straight foot and a bent foot, and the locking assembly may engage the straight foot and the bent foot to secure the shackle to the crossbar.

14 Claims, 7 Drawing Sheets

(56) References Cited

U.S. PATENT DOCUMENTS 3,882,699 A * 5/1975 Flack ..... E05B 67/38 70/368
4,112,715 A * 9/1978 Uyeda ..... E05B 67/24 70/38 A
4,241,594 A * 12/1980 Miller ..... E05B 67/24 70/369
4,290,280 A * 9/1981 Yun ..... E05B 67/24 70/38 A
4,345,447 A * 8/1982 Keung ..... E05B 67/24 292/37
4,464,915 A 8/1984 Moshe et al.
4,551,997 A * 11/1985 Huang ..... E05B 67/04 70/38 A
4,730,470 A * 3/1988 Zane ..... B60R 25/0221 70/199
4,881,387 A * 11/1989 Kortenbrede ..... E05B 67/063 70/26
4,920,772 A * 5/1990 Denison ..... E05B 67/063 70/233
5,010,746 A * 4/1991 Zane ..... E05B 67/063 70/233
5,092,142 A * 3/1992 Zane ..... E05B 67/063 70/233
5,142,888 A * 9/1992 Ling ..... E05B 37/025 70/26
5,186,029 A * 2/1993 Myers ..... E05B 67/24 70/371
5,189,893 A * 3/1993 Kortenbrede ..... E05B 67/24 70/379 R
5,253,496 A * 10/1993 Wang ..... B62H 5/14 70/38 R
5,331,830 A * 7/1994 Su ..... E05B 67/063 70/38 A
5,372,019 A * 12/1994 Hsiao ..... B60R 25/066 70/209
5,394,712 A * 3/1995 Chou ..... E05B 67/063 70/226
5,398,529 A * 3/1995 Goldman ..... E05B 67/22 70/38 A
5,406,812 A * 4/1995 Jaw ..... E05B 67/063 70/233
5,417,092 A * 5/1995 Iu ..... E05B 67/063 70/38 A
5,488,845 A * 2/1996 Hsieh ..... E05B 67/24 70/233
5,706,679 A * 1/1998 Zane ..... E05B 67/003 70/18
5,787,736 A * 8/1998 Ling ..... E05B 37/025 70/26
5,819,560 A * 10/1998 Grahovec ..... E05B 67/02 70/31
5,823,021 A * 10/1998 Chang ..... E05B 67/063 70/233
5,832,762 A * 11/1998 McDaid ..... E05B 17/002 70/38 A
5,839,302 A * 11/1998 Chu ..... E05B 35/12 70/339
5,931,030 A * 8/1999 Chen ..... E05B 9/084 70/371
5,950,461 A * 9/1999 Tsai ..... E05B 67/24 70/379 R
5,987,940 A * 11/1999 Chang ..... E05B 27/001 70/358
6,101,852 A * 8/2000 Steinbach ..... E05B 67/06 70/38 A
6,212,922 B1 * 4/2001 Miao ..... E05B 73/0005 70/57
6,341,509 B1 * 1/2002 McDaid ..... E05B 9/084 70/371
6,666,051 B1 * 12/2003 Li ..... B60D 1/60 280/507
6,694,781 B1 * 2/2004 Li ..... B60D 1/06 280/507
6,718,802 B2 * 4/2004 Vito ..... B62H 5/00 70/18
6,725,692 B2 * 4/2004 Weinraub ..... F41A 17/44 70/38 A
7,121,121 B2 * 10/2006 Wyers ..... B60D 1/065 280/507
7,948,359 B2 * 5/2011 Marcelle ..... G07C 9/00182 340/5.64
8,127,577 B2 * 3/2012 Buhl ..... E05B 17/0062 70/38 A
9,163,431 B2 * 10/2015 Young ..... E05B 67/063
2002/0053226 A1 5/2002 McDaid
2009/0282876 A1 * 11/2009 Zuraski ..... E05B 67/003 70/35
2012/0318028 A1 * 12/2012 Hahn ..... E05B 67/063 70/41

FOREIGN PATENT DOCUMENTS

DE 19638188 A1 3/1998
DE 202013103393 U1 8/2013
EP 2020474 A2 2/2009

OTHER PUBLICATIONS

Written Opinion; International Searching Authority; International PCT Application No. PCT/US2015/035575; dated Nov. 4, 2015; 6 pages.
Extended Supplementary European Search Report; European Patent Office; European Patent Application No. 15807117.5; dated Jan. 2, 2018; 5 pages.
Canadian Office Action; Canadian Intellectual Property Office; Canadian Patent Application No. 2,954,358; dated Jul. 30, 2018; 3 pages.
Chinese Search Report; State Intellectual Property Office, Peoples Republic of China; Chinese Patent Application No. 201580038154.2; dated Jun. 14, 2018; 3 pages.
Chinese Office Action; State Intellectual Property Office, Peoples Republic of China; Chinese Patent Application No. 201580038154.2; dated Jun. 28, 2018; 9 pages.
Extended Supplementary European Search Report; European Patent Office; European Patent Application No. 18215734.7; dated Apr. 23, 2019; 7 pages.
Canadian Office Action; Canadian Intellectual Property Office; Canadian Patent Application No. 2,954,358; dated Mar. 19, 2019; 3 pages.

* cited by examiner

HOOP LOCK WITH DUAL LOCKING

CROSS-REFERENCE TO RELATED APPLICATIONS

The present application claims the benefit of U.S. Provisional Patent Application No. 62/011,470 filed on Jun. 12, 2014, the contents of which are incorporated herein by reference in their entirety.

TECHNICAL FIELD

The present invention generally relates to shackle locks, and more particularly, but not exclusively, to locks having a removable shackle.

BACKGROUND

Shackle-type locks are commonly used to secure a portable object such as a bicycle to a stationary object such as a rack. Such locks are sometimes referred to as U-locks, hoop locks, or bicycle locks. Some locks of this type have certain limitations, such as those relating to resistance to tampering, attack, and high pull forces. Therefore, a need remains for further improvements in this technological field.

SUMMARY

An exemplary hoop lock includes a shackle, a crossbar, and a locking assembly operable to secure the shackle to the crossbar. The shackle may include a straight foot and a bent foot, and the locking assembly may engage the straight foot and the bent foot to secure the shackle to the crossbar. Further embodiments, forms, features, aspects, benefits, and advantages of the present application shall become apparent from the description and figures provided herewith.

DETAILED DESCRIPTION OF ILLUSTRATIVE EMBODIMENTS

Figure 1:
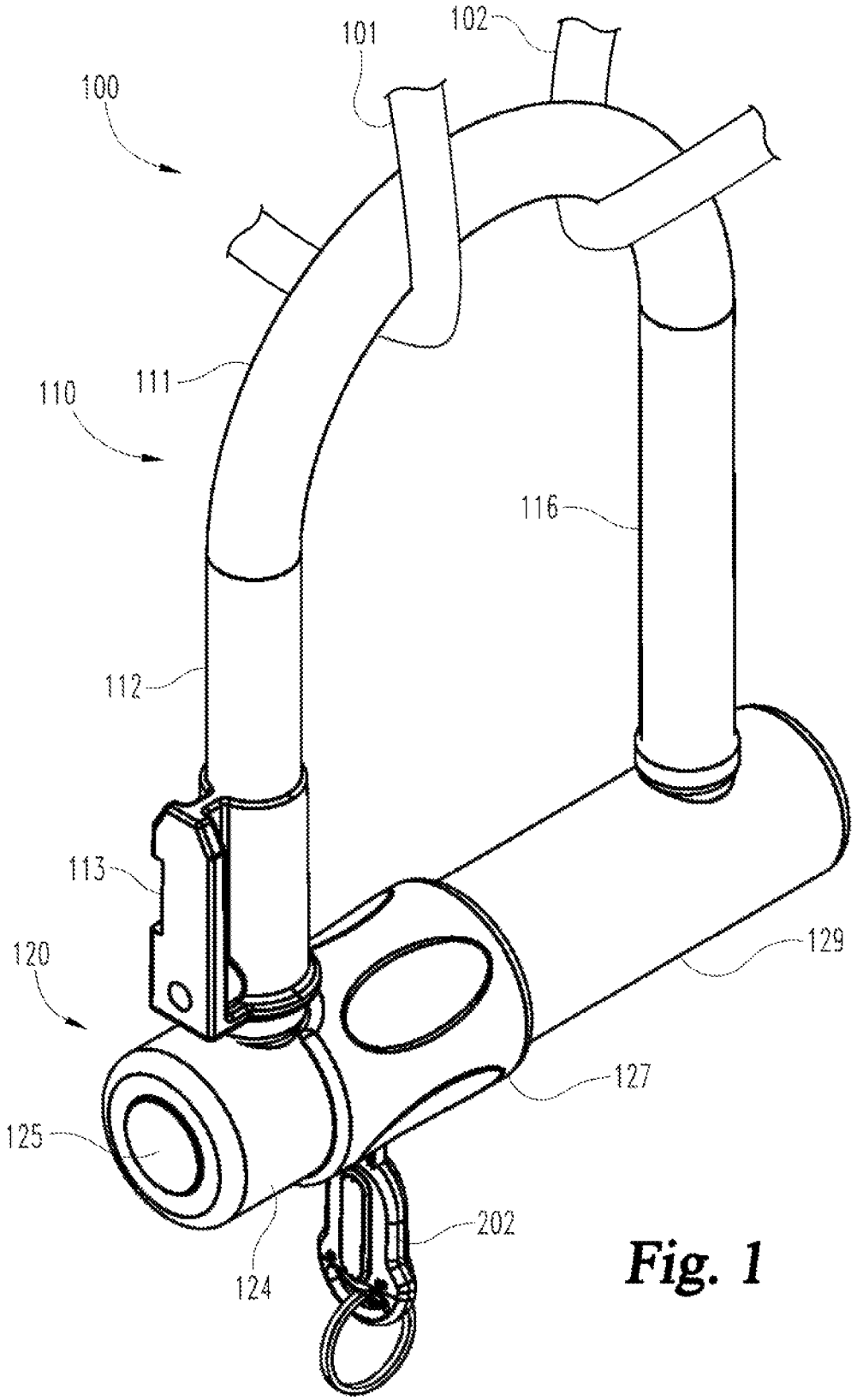
FIG. 1 is an isometric view of a lock according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
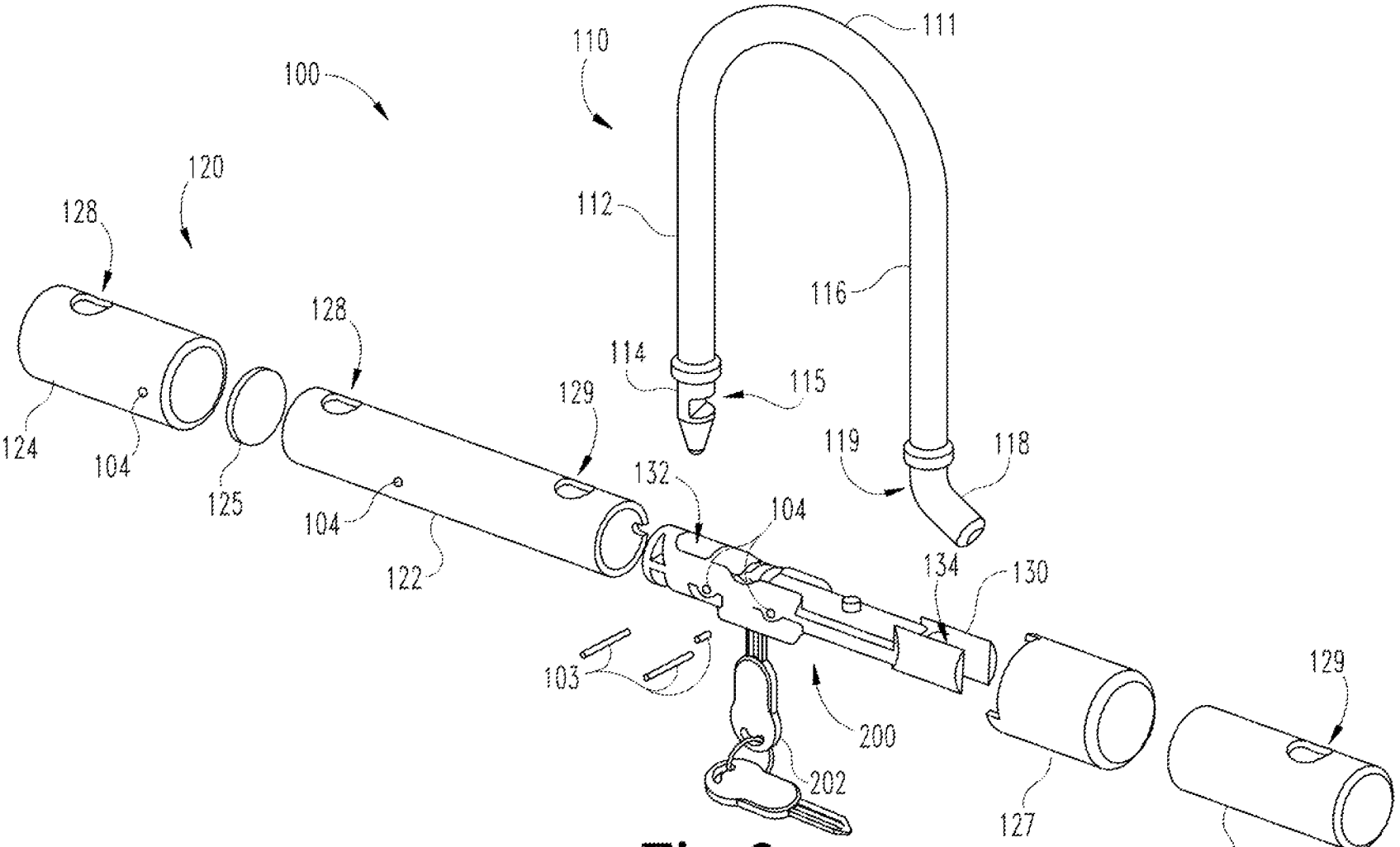
FIG. 2 is an exploded assembly view of the lock.

With reference to FIGS. 1 and 2, an exemplary lock 100 according to one embodiment includes a hoop or shackle 110 and a barrel or crossbar 120, which includes a housing 130 and a locking assembly 200. As described in further detail below, the shackle 110 and crossbar 120 are separable, and the locking assembly 200 is operable to selectively secure the crossbar 120 to the shackle 110. The lock 100 may be used to secure a first object 101 to a second object 102, for example to prevent theft or unauthorized separation of the objects 101, 102.

The shackle 110 includes an arcuate connecting portion 111 connecting a first leg 112 having a first foot 114 to a second leg 116 having a second foot 118. In the illustrated form, the legs 112, 116 are substantially parallel to one another, and the connecting portion 111 defines a semicircle, such that the shackle 110 is substantially U-shaped. It is also contemplated that shackle 110 may be of another shape. By way of example, the connecting portion 111 may be substantially rectilinear.

The first foot 114 is substantially coaxial with the first leg 112, while the second foot 118 is angularly offset with respect to the second leg 116. As such, the first foot 114 may be considered a straight foot, and the second foot 118 may be considered an angled or bent foot. The first foot 114 includes a first notch 115, and the second foot 118 includes a second notch 119. As described in further detail below, the notches 115, 119 are engageable with the locking assembly 200 to selectively couple the shackle 110 to the crossbar 120. The shackle 110 may further include bumpers 117 adjacent the feet 114, 118.

The crossbar 120 includes a substantially cylindrical tube 122, and a sleeve 124 operable to receive a first end portion of the tube 122 such that an end cap 125 is retained on the first end of the tube 122. The crossbar 120 also includes a tube cover 126 operable to receive a second end portion of the tube 122, and may further include a dust cover 127. The tube 122 and sleeve 124 each include a first or proximal opening 128 operable to receive the first foot 114, and the tube 122 and tube cover 126 each include a second or distal opening 129 operable to receive the second foot 118. When assembled, the housing 130 and locking assembly 200 are retained within the tube 122 between the end cap 125 and the tube cover 126. During assembly, fasteners such as assembly pins 103 may be passed through openings 104 in the various elements of the crossbar 120 to secure the elements in their proper positions.

Figure 3:
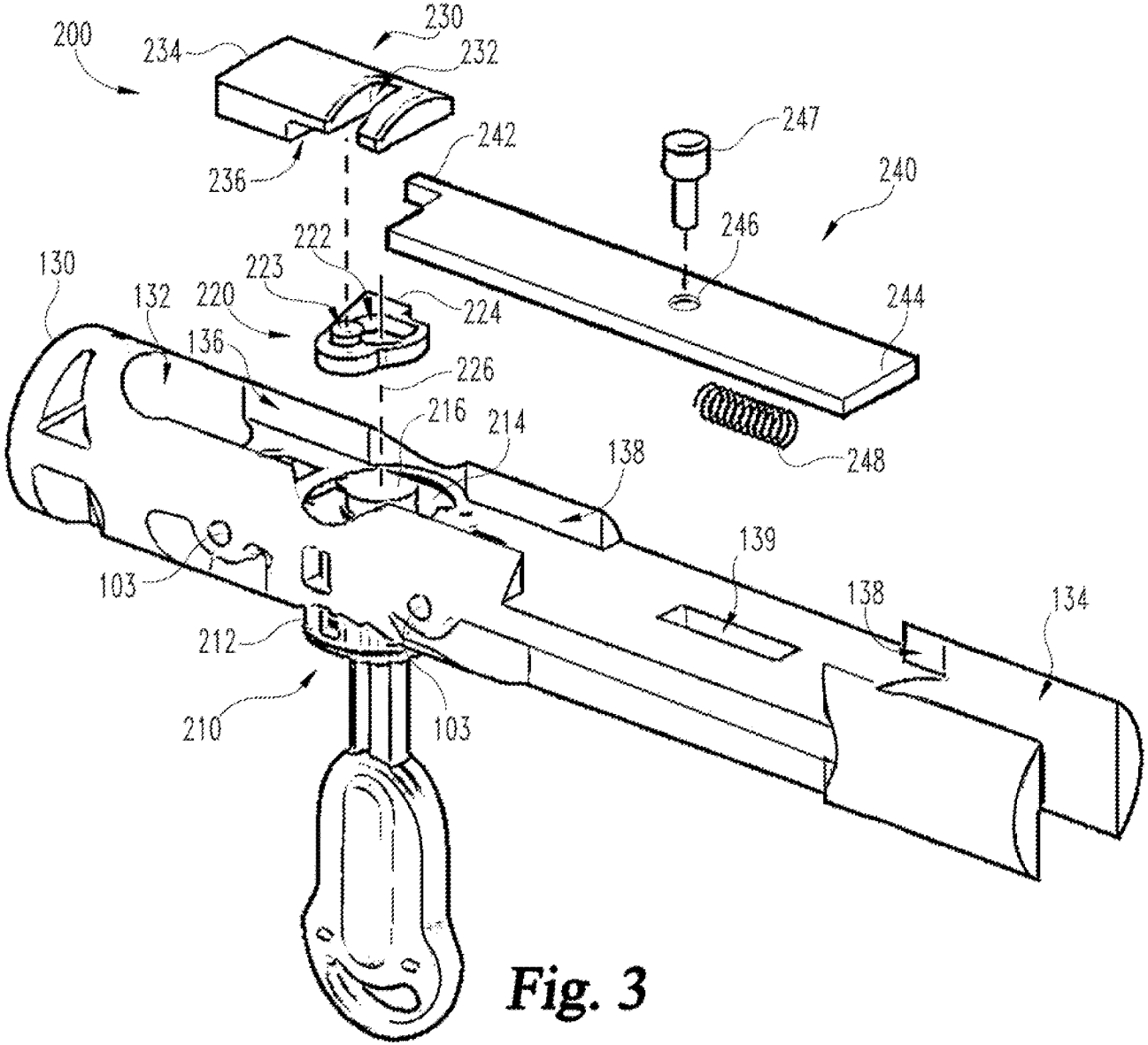
FIG. 3 is an exploded assembly view of a locking subassembly according to one embodiment.

With additional reference to FIG. 3, the locking assembly 200 includes a lock cylinder 210, a cam 220 connected to the lock cylinder 210, a primary bolt 230 operable to engage the first or proximal foot 114, and a secondary bolt 240 operable to engage the second or distal foot 118. The housing 130 may include channels 136, 138 which receive at least a portion of the primary and secondary bolts 230, 240 to constrain motion of the bolts 230, 240 to a path substantially parallel to a longitudinal axis of the crossbar 120. As described in further detail below, the bolts 230, 240 are engaged with the cam 220 such that the bolts 230, 240 extend or retract in response to rotation of the cam 220.

The lock cylinder 210 includes a shell 212 coupled to the housing 130, and a spindle 214 which is rotatable with respect to the shell 212 upon insertion of a proper key 202. While the illustrated lock cylinder 210 is a rotary disc tumbler lock, it is also contemplated that other forms of lock cylinders, including those which utilize sliding wafers and/or pin tumblers, may be utilized. When assembled, the lock cylinder 210 is positioned in the housing 130 such that the keyway 215 thereof is aligned with openings 123 in the tube 122 and sleeve 124. The spindle 114 also includes a spindle extension 216 configured to engage the cam 220, such that when the proper key 202 is inserted and rotated, the spindle extension 216 rotates the cam 220.

While other configurations are contemplated, in the illustrated form, the lock cylinder 210 is offset from the longitudinal center of the crossbar 120, is positioned between the feet 114, 118, and is closer to the primary foot 114 than to the secondary foot 118. As such, the opening 123 in the tube 122 is also offset from the center of the crossbar 120, and is positioned longitudinally between and radially across from the openings 128, 129. Additionally, the keyway 215 is substantially parallel to a central axis of the opening 128, such that when the shackle 110 is coupled to the crossbar 120 and the key 202 is inserted, the shank of the key 202 is substantially parallel to the legs 112, 116. In embodiments which employ the dust cover 127, the dust cover 127 may also include an opening 123 which is selectively alignable with the keyway 215, such that when the dust cover opening 123 is not aligned with the keyway 215, dirt and other contaminants are blocked from entering the keyway 215.

The cam 220 is configured to translate rotary motion of the spindle extension 216 to linear motion of the bolts 230, 240, and is rotationally coupled to the extension 216. For example, the cam 220 may include an opening 222 having a geometry corresponding to that of the extension 216. The cam 220 includes a projection or protrusion 223 operable to engage the primary bolt 230, and a cam arm 224 operable to engage the secondary bolt 240. The illustrated protrusion 223 is offset from a rotational axis 226 of the cam 220, and is provided in the form of an axial protrusion. In other words, the protrusion 220 extends in the direction of the rotational axis 226. Additionally, the illustrated cam arm 224 is a radial arm which extends away from the rotational axis 226 at least partially in the radial direction. As described in further detail below, rotation of the cam 220 in a first direction causes the bolts 230, 240 to retract toward unlocking positions, and rotation of the cam 220 in a second direction causes the bolts 230, 240 to extend toward locking positions.

The primary bolt 230 includes a channel 232 sized and configured to receive the cam protrusion 223, and an engagement end 234 operable to engage the first foot 114. More specifically, the engagement end 234 is configured to be received in the first notch 115, and may have a thickness corresponding to a width of the first notch 115. The primary bolt 230 may further include an undercut 236 having a depth corresponding to a width of the secondary bolt 240, such that a portion of the secondary bolt 240 may be positioned between the primary bolt 230 and the housing 130.

The secondary bolt 240 includes a post 242 operable to engage the cam arm 224, and an engagement end 244 operable to engage the second foot 118. More specifically, the engagement end 244 is configured to be received in the second notch 119, and may have a thickness corresponding to a width of the second notch 119. The secondary bolt 240 may further include an opening 246 and a pin 247 extending through the opening 246. A spring 248 may be positioned in a cavity 139 in the housing 130 and engaged with the pin 247 such that the secondary bolt 240 is biased toward the retracted or unlocking position.

Figure 4:
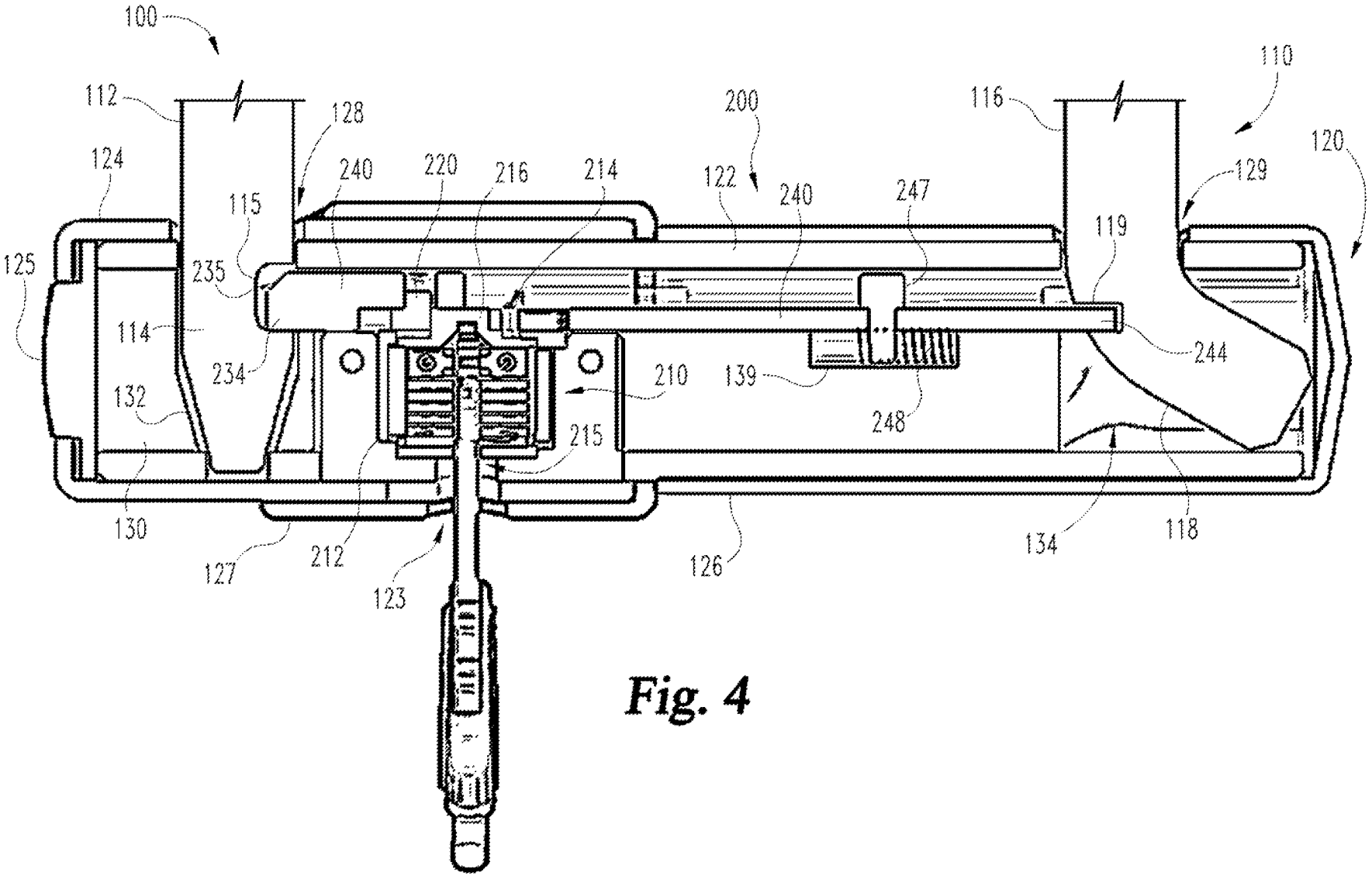
FIG. 4 is a cross-sectional view of the lock in a locked state.
Figure 5:
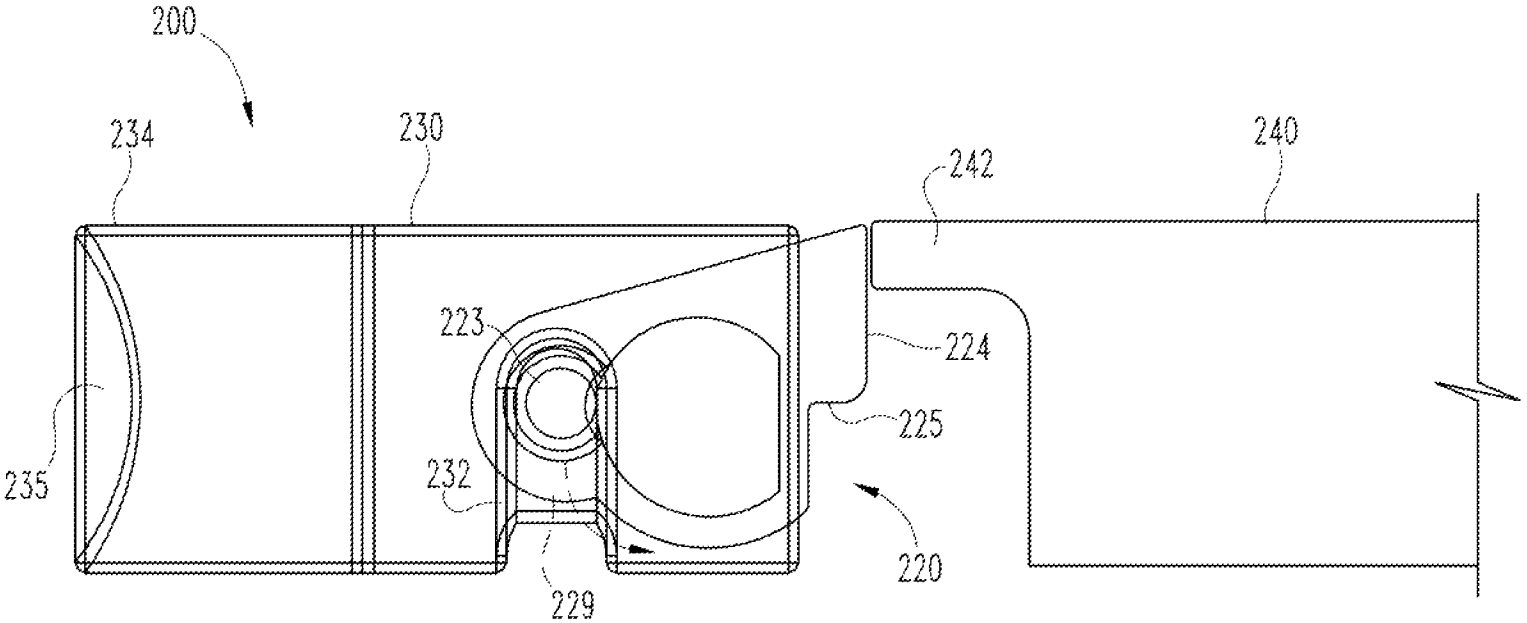
FIG. 5 is an elevational view of the locking subassembly in the locked state.
Figure 6:
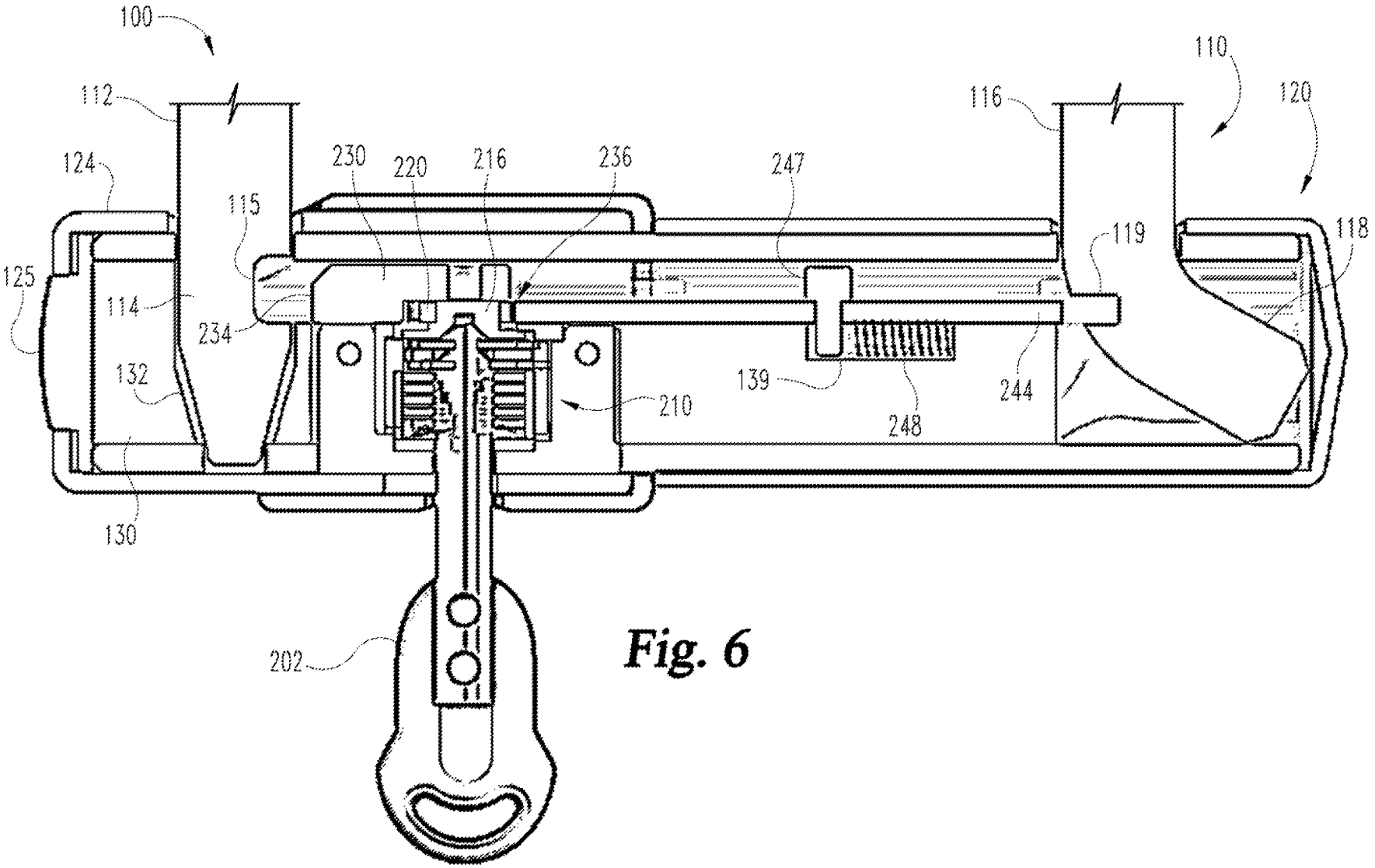
FIG. 6 is a cross-sectional view of the lock in an unlocked state.
Figure 7:
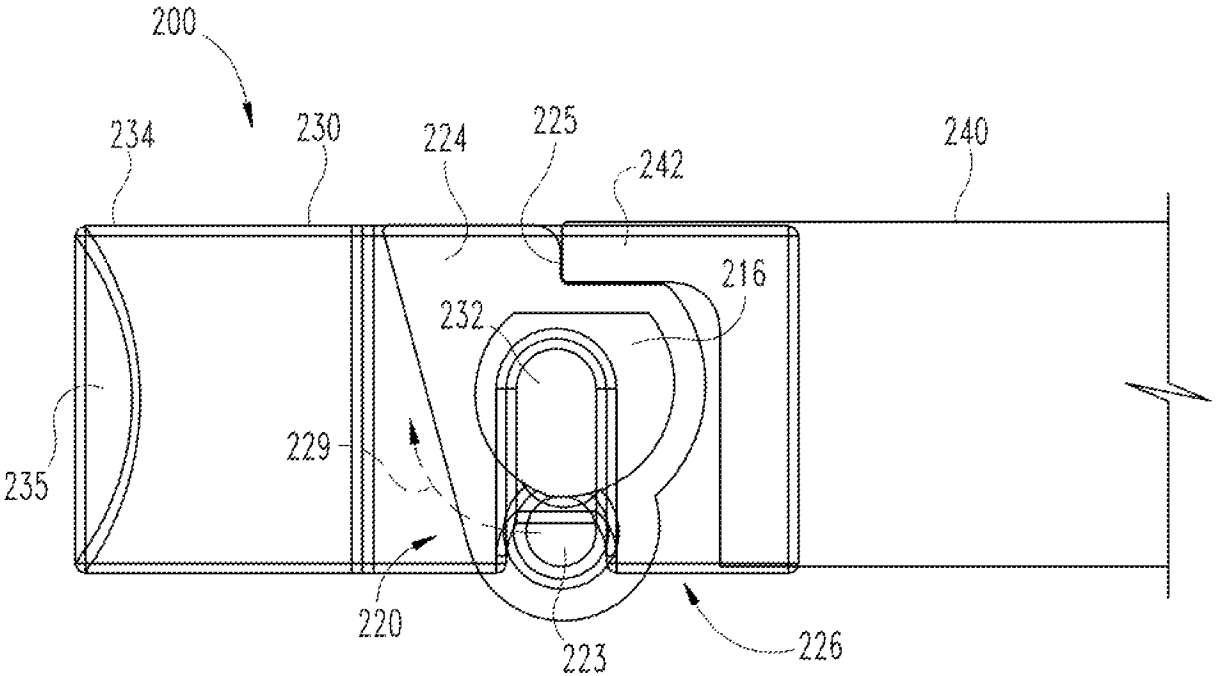
FIG. 7 is an elevational view of the locking subassembly in the unlocked state.

With additional reference to FIGS. 4-7, operation of the exemplary hoop lock 100 will now be described. FIGS. 4 and 5 depict the lock 100 in the locked state, and FIGS. 6 and 7 depict the lock 100 in the unlocked state. More specifically, FIGS. 4 and 6 depict a cross-sectional view of the lock 100, and FIGS. 5 and 7 depict an elevational view of the locking assembly 200.

With specific reference to FIGS. 4 and 5, when the lock 100 is in the locked state, the primary bolt 230 is engaged with the first foot 114, and the secondary bolt 240 is engaged with the second foot 118. More specifically, the primary bolt engagement end 234 is received in the first notch 115, and the secondary bolt engagement end 244 is received in the second notch 119. Engagement between the bolts 230, 240 and the feet 114, 118 securely couples the shackle 110 to the crossbar 120.

In the locked state, if a person were to cut the shackle 110, for example through one of the legs 112, 116 (see cut 109, FIG. 1), each of the feet 114, 118 would remain securely coupled to the crossbar 120. The notches 115, 119 and the bolts 230, 240 may be configured such that each of the legs 112, 116 is independently prevented from rotating about its longitudinal axis. In such forms, even if the shackle 110 is cut as described above, the connecting portion 111 cannot be pivoted to provide an opening through which one of the objects 101, 102 may pass.

The primary foot notch 115 has a first width, the secondary foot notch 119 has a second width, and each of the engagement ends 234, 244 has a thickness corresponding to the width of the notch 115, 119 in which the engagement end is received. The notch 119 in the angled foot 118 may have a lesser width than the notch 115 in the straight foot 114. For example, the angled foot 118 may be pre-stressed due to manufacturing processes, and providing the second notch 119 with a lesser width may improve the structural integrity of the angled foot 118 as compared to if the second notch 119 were to be provided with the same width as the first notch 115.

In the locked state, the cam protrusion 223 is positioned at an end of the primary bolt channel 232, and a radially outer surface of the cam arm 224 is engaged with the secondary bolt post 242. When no key is inserted in the lock cylinder 210, the spindle 214, and thus the cam 220, cannot be rotated. As such, the protrusion 223 and cam arm 224 retain the bolts 230, 240 in extended or locking positions, thereby deadlocking the bolts 230, 240. When a proper key 202 is used to rotate the spindle 214, the spindle extension 216 causes the cam 220 to rotate in an unlocking direction (counter-clockwise in FIG. 5). Rotation of the cam 220 causes the radially offset protrusion 223 to travel along an arcuate path 229, and causes the cam arm 224 to move away from the secondary bolt 240. As the protrusion 223 moves along the path 229, it slides within the channel 232 and retracts the primary bolt 230. As the cam arm 224 moves away from the secondary bolt 240, the spring 248 urges the bolt 240 toward the retracted position.

With specific reference to FIGS. 6 and 7, when the key 202 is fully rotated, the lock 100 is in the unlocked state. In the unlocked state, the bolts 230, 240 are in retracted or unlocking positions, and are disengaged from the feet 112, 116 such that the shackle 110 can be removed from the crossbar 120. In the unlocked state, the cam protrusion 223 is positioned in the primary bolt channel 232 adjacent an edge of the primary bolt 230, and the post 242 abuts a side surface 225 of the cam arm 224. Additionally, the post 242 is positioned within the undercut 236 between the primary bolt 230 and the lock cylinder 210. In other words, when the locking assembly 200 is in the unlocked state, a portion of the primary bolt 230 overlaps a portion of the secondary bolt 240.

When the key 202 is subsequently rotated to transition the locking assembly 200 to the locked state, the cam protrusion 223 travels along the arcuate path 229 in the direction opposite that which it travels during the unlocking operation (clockwise in FIG. 7), and the cam arm 224 rotates toward the second foot 118. As the protrusion 223 moves along the arcuate path 229, it slides within the channel 232 and extends the primary bolt 230, thereby moving the engagement end 234 into the first notch 115. The engagement end 234 may include a tapered surface or chamfer 235, for example to allow for some misalignment between the engagement end 234 and the notch 115.

As the cam arm 224 rotates toward the second foot 118, the cam arm 224 urges the secondary bolt 240 in the direction of extension, thereby moving the engagement end 244 into the second notch 119. The cam arm 224 may include a rounded corner to provide for a smoother transition as the post 242 travels along the outer surface of the cam 220. As the secondary bolt 240 extends, the spring 248 is compressed between the pin 247 and the side surface of the cavity 139. Additionally, the pin 247 may slide along the inner surface of the tube 122, thereby preventing the secondary bolt 240 from pivoting during extension or retraction. In other words, the pin 247 is positioned partially between the secondary bolt 240 and an inner surface of the tube 122, thereby preventing the secondary bolt 240 from moving toward the inner surface.

As can be seen from the foregoing, the exemplary locking assembly 200 is operable in a locking state and an unlocking state. In the locking state, the bolts 230, 240 engage the feet 114, 118 to secure the shackle 110 to the crossbar 120. In the unlocking state, the bolts 230, 240 are disengaged from the feet 114, 118, and the shackle 110 can be removed from the crossbar 120. Additionally, the state of the locking assembly 200 corresponds to the rotational position of the cam 220. In other words, the locking assembly 200 is operable in the locking state in response to a first rotational position of the cam 220, and is operable in the unlocking state in response to a second rotational position of the cam 220.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A hoop lock, comprising:

a shackle including first and second substantially parallel legs, wherein the first leg includes a first foot aligned with the first leg, and the second leg includes a second foot angularly offset with respect to the second leg such that the second foot extends at an oblique angle relative to the first foot, wherein the first foot includes a first notch and the second foot includes a second notch;

a tube including a first opening configured to receive the first foot and a second opening configured to receive the second foot; and an asymmetric locking assembly positioned in the tube, the locking assembly comprising:

a lock cylinder including a spindle, wherein the spindle is rotatable in response to insertion of a proper key into the lock cylinder;

a cam rotationally coupled to the spindle, and including a radial arm and an axial protrusion having a different configuration from the radial arm, wherein the axial protrusion is radially offset from a rotational axis of the cam, and wherein the cam is asymmetric about the rotational axis;

a primary bolt including a channel, wherein the axial protrusion is received in the channel to define a first engagement interface between the primary bolt and the cam;

a secondary bolt including a post engaged with the radial arm to define a second engagement interface between the secondary bolt and the cam; and a biasing member urging the secondary bolt toward the cam;

wherein the first engagement interface and the second engagement interface are of different configurations;

wherein the locking assembly has a locking state in response to a first rotational position of the cam and an unlocking state in response to a second rotational position of the cam;

wherein, in the locking state, an engagement portion of the primary bolt is received in the first slot and an engagement portion of the secondary bolt is received in the second slot; and wherein, in the unlocking state, the engagement portions are not received in the slots;

wherein the secondary bolt has an extended position in the locking state and a retracted position in the unlocking state; and wherein the biasing member urges the secondary bolt from the extended position toward the retracted position.

2. The hoop lock of claim 1, wherein in the unlocking state, the post is positioned between the primary bolt and the lock cylinder.

3. The hoop lock of claim 1, wherein the first notch has a first width, the second notch has a second width less than the first width, the primary bolt has a first thickness corresponding to the first width, and the secondary bolt has a second thickness corresponding to the second width.

4. The hoop lock of claim 1, wherein the first engagement interface is operable to push the primary bolt toward the first leg and to pull the primary bolt away from the first leg; and wherein the second engagement interface is operable to push the primary bolt toward the second leg, and is inoperable to pull the primary bolt away from the second leg.

5. The hoop lock of claim 1, wherein the first engagement interface is operable to transmit both pushing forces and pulling forces between the cam and the primary bolt; and wherein the second engagement interface is configured to transmit pushing forces between the cam and the secondary bolt but is not operable to transmit pulling forces between the cam and the secondary bolt.

6. The hoop lock of claim 1, wherein the first engagement surface is configured to provide for bidirectional transmission of forces between the cam and the primary bolt; and wherein the second engagement surface is configured to provide for unidirectional transmission of forces between the cam and the secondary bolt.

7. The hoop lock of claim 1, wherein the first engagement interface is configured to push the primary bolt into engagement with the first leg as the cam rotates from the second rotational position to the first rotational position;

wherein the first engagement interface is configured to pull the primary bolt out of engagement with the first leg as the cam rotates from the first rotational position to the second rotational position;

wherein the second engagement interface is configured to push the secondary bolt into engagement with the second leg as the cam rotates from the second rotational position to the first rotational position; and wherein the second engagement interface is not operable to pull the secondary bolt out of engagement with the second leg as the cam rotates from the first rotational position to the second rotational position.

8. A lock, comprising:

a shackle comprising a first leg including a straight foot, and a second leg including an angled foot, wherein the angled foot extends at an oblique angle relative to the straight foot, wherein the straight foot includes a first notch having a first width, and wherein the angled foot includes a second notch having a second width less than the first width; and a crossbar selectively coupled to the shackle, wherein the crossbar includes a tube in which the straight foot and the angled foot are received, wherein the crossbar further includes an asymmetric locking assembly positioned in the tube, and wherein the asymmetric locking assembly comprises:

a lock cylinder including a spindle which is rotatable upon insertion of a proper key, wherein the lock cylinder is seated in the tube and is nearer to the straight foot than to the angled foot;

a cam coupled to the spindle, the cam including a radial arm and an axial protrusion, wherein the axial protrusion is radially offset from a rotational axis of the cam, wherein the cam is asymmetric about the rotational axis;

a primary bolt including a channel in which the axial protrusion is received to define a first engagement interface between the primary bolt and the cam, wherein the primary bolt has a first length and a first thickness, and wherein the first thickness corresponds to the first width such that the first notch is operable to receive a first end portion of the primary bolt;

a secondary bolt including a post engaged with the arm to define a second engagement interface between the secondary bolt and the cam, wherein the secondary bolt has a second length and a second thickness, wherein the second length is greater than the first length, and wherein the second thickness is less than the first thickness and corresponds to the second width such that the second notch is operable to receive a second end portion of the secondary bolt; and a biasing member urging the secondary bolt away from the angled foot;

wherein the first engagement interface between the primary bolt and the cam is of a different configuration than the second engagement interface between the secondary bolt and the cam;

wherein the cam is operable to rotate about the rotational axis between a locking position and an unlocking position;

wherein the axial protrusion is configured to drive the primary bolt into engagement with the straight foot as the cam rotates from the unlocking position to the locking position, thereby causing the first end portion to enter the first notch;

wherein the axial protrusion is configured to drive the primary bolt out of engagement with the straight foot as the cam rotates from the locking position to the unlocking position, thereby causing the first end portion to exit the first notch;

wherein the radial arm is configured to drive the secondary bolt into engagement with the angled foot as the cam rotates from the unlocking position to the locking position, thereby causing the second end portion to enter the second notch;

wherein the biasing member is configured to drive the secondary bolt out of engagement with the angled foot as the cam rotates from the locking position to the unlocking position, thereby causing the second end portion to exit the second notch.

9. The lock of claim 8, further comprising a pin positioned at least partially between the secondary bolt and an inner surface of the tube, wherein the pin is configured to prevent the secondary bolt from moving toward the inner surface.

10. A lock, comprising:

a shackle comprising a first leg and a second leg, the first leg including a straight foot, the second leg including an angled foot extending at an oblique angle relative to the straight foot, wherein the straight foot includes a first notch, and wherein the angled foot includes a second notch; and a crossbar selectively coupled to the shackle, wherein the crossbar includes a tube in which the straight foot and the angled foot are received, wherein the crossbar further includes an asymmetric locking assembly positioned in the tube, and wherein the asymmetric locking assembly comprises:

a lock cylinder including a spindle;

a cam coupled to the spindle, the cam including a radial arm and an axial protrusion that is radially offset from a rotational axis of the cam;

a primary bolt including a channel in which the axial protrusion is received to define a first engagement interface between the primary bolt and the cam;

a secondary bolt abutting the radial arm to define a second engagement interface between the secondary bolt and the cam; and a spring biasing the secondary bolt away from the bent foot;

wherein the first engagement interface between the primary bolt and the cam is of a different configuration than the second engagement interface between the secondary bolt and the cam, thereby defining a first asymmetry of the asymmetric locking assembly; and wherein the cam is operable to rotate about the rotational axis between a locking position and an unlocking position;

wherein the axial protrusion is configured to drive the primary bolt into engagement with the first notch as the cam rotates from the unlocking position to the locking position, and to drive the primary bolt out of engagement with the first notch as the cam rotates from the locking position to the unlocking position;

wherein the radial arm is configured to drive the secondary bolt into engagement with the second notch as the cam rotates from the unlocking position to the locking position, and to permit the secondary bolt to move out of engagement with the second notch under the force of the spring as the cam rotates from the locking position to the unlocking position.

11. The lock of claim 10, wherein the first notch has a first width; wherein the second notch has a second width less than the first width; wherein the primary bolt has a first thickness corresponding to the first width; wherein the secondary bolt has a second thickness corresponding to the second width; and wherein the first thickness is greater than the second thickness, thereby defining a second asymmetry of the locking assembly.

12. The lock of claim 10, wherein the secondary bolt is biased away from the bent foot and wherein the primary bolt is unbiased, thereby defining a second asymmetry of the asymmetric locking assembly.

13. The lock of claim 10, wherein the primary bolt is driven from a first locking position to a first unlocking position by the cam, and wherein the secondary bolt is driven from a second locking position to a second unlocking position by the spring, therefore defining a second asymmetry of the asymmetric locking assembly.

14. The lock of claim 10, wherein the cam has an outer periphery that is inoperable to exhibit mirror image symmetry relative to a plane defined along the rotational axis, thereby defining a second asymmetry of the asymmetric locking assembly.

* * * * *